US005540368A

United States Patent [19]

Oliva

[11] Patent Number: 5,540,368

[45] Date of Patent: Jul. 30, 1996

[54] MULTI-PURPOSE HOLSTER APPARATUS

[76] Inventor: Ronald Oliva, 2824 NW. Eighth Ave., Fort Lauderdale, Fla. 33311

[21] Appl. No.: 304,275

[22] Filed: Sep. 12, 1994

Related U.S. Application Data

[63] Continuation-in-part of Ser. No. 88,214, Jul. 6, 1993, Pat. No. 5,375,749, which is a continuation-in-part of Ser. No. 752,879, Aug. 30, 1991, abandoned.

[51] Int. Cl.[6] ..... A45F 5/00

[52] U.S. Cl. ..... 224/271; 224/242; 224/272; 224/904; 224/908; 224/673; 224/930; 24/191; 24/194; 24/197; 24/3.12

[58] Field of Search ..... 224/224–226, 224/242, 245, 246, 250, 252, 253, 268–272, 904, 908; 24/3.12, 3.9, 163 K, 191, 193, 194, 197, 616, 625; 352/243; 354/82

[56] References Cited

U.S. PATENT DOCUMENTS 4,419,794 12/1983 Horton, Jr. et al. ..... 224/272 X
5,054,170 10/1991 Otrusina ..... 224/272 X
5,274,885 1/1994 Hellweg ..... 24/3.12

FOREIGN PATENT DOCUMENTS 1237437 3/1967 Germany ..... 224/252

*Primary Examiner*—J. Casimer Jacyna
*Attorney, Agent, or Firm*—Malin, Haley, DiMaggio & Crosby

[57] ABSTRACT

An improved multi-purpose holster apparatus suitable for holding a variety of objects including flashlights, mobile telephones, tools, etc., wherein the apparatus comprises a rigid or semi-rigid frame defining a channel for receiving a belt, a female adapter protruding from the frame, an object support adapter which supports the object to be mounted to the frame and a male adapter extending from the object support adapter which mates with the female adapter for mounting the object and the object support adapter to the frame.

23 Claims, 7 Drawing Sheets

MULTI-PURPOSE HOLSTER APPARATUS

This application is a continuation-in-part of U.S. Ser. No. 8/088,214, filed Jul. 6, 1993, now U.S. Pat. No. 5,375,749, which was a continuation-in-part of U.S. Ser. No. 07/752,879, filed Aug. 30, 1991, now abandoned.

BACKGROUND OF THE INVENTION

1. Field of the Invention

This invention relates generally to an improved multi-purpose holster apparatus for securing hand held products to a belt, and more particularly, to a holster apparatus having an improved support frame that releasably attaches to a belt and an improved corresponding support adaptor that provides increased stability and durability. The support frame has an improved locking mechanism and less movable parts while the adaptor is stronger, less cumbersome and adaptable to a wider variety of products, such as, flashlights, tools, telephones, radios, battery packs, cameras, waist pouches and other hand held items.

2. Description of the Prior Art

The subject invention provides a multi-purpose holster apparatus that is an improvement over the device disclosed in the prior applications, U.S. application Ser. Nos. 08/088,214 and 07/752,879, and other conventional holsters. The improved holster introduces a structure that is easier to mount to a person's belt, has an improved locking mechanism that increases the interlocking security of the male support adapter inside the female adapter as defined by the frame and includes a number of male support adapters that are adaptable for permanent attachment to a host of objects without hindering use of the objects.

The holster apparatus disclosed in U.S. application Ser. No. 08/088,214 teaches a support frame mounted and secured to a belt by way of a planar securing member and securing spacers, and a female adapter protruding from the support frame. The female adapter defines a recession for mating and interlocking with a cylindrical male adapter having a circumferential groove. The groove sits inside the recession while a button defined by the male adaptor intersects the female adapter. In the noted device, the male adapter is directly affixed to the object by adhesives, hardware or some other securing medium and is secured in the female adapter by a slidable key which is traversed over the male adapter in a locked position to prevent undesired removal of the male adapter.

The present invention is an improvement in that a support adapter is joined with the male adapter to define a male support adapter combination that offers improved security and object accessibility. One such adapter receives and mounts objects, such as flashlights or telephones, on the frame instead of separately adhering the male adapter directly to the object being held. Another support adapter slidably engages a sleeve permanently affixed to the object. The advantage of this improved sleeve adaptor is that the sleeve is somewhat flat so as to not interfere with use of the product and it facilitates more secure and permanent attachment to the item. In addition, the instant invention provides a slidable key locking mechanism having an improved interlocking feature, a male adapter defining an optional rectangular portion or shaft that may be incorporated for preventing rotation within the female recession and a "C" shaped spacer that may be fixedly secured inside the frame as a semipermanent piece to prevent inadvertent removal of the spacer.

SUMMARY OF THE INVENTION

In light of the above-noted, it is an object of the instant invention to provide an improved multi-purpose holster comprising an object support adapter integrally combined with a male adapter for attachment to a belt-mounted frame having a corresponding female adapter protruding from the frame, and a slidable key that prevents the undesired removal of the male adapter.

It is another object of the present invention to provide an improved multi-purpose holster that is easier to mount to an existing belt, that increases the security of the object being supported, and that makes the object more accessible.

It is an additional object of the present invention to provide a multi-purpose holster comprising an object support adapter that may prevent rotation of the object when mated with a belt-mounted frame having a female adapter.

It is also an object of the present invention to provide a multi-purpose holster apparatus that has a plurality of object support adapters for supporting a variety of objects.

It is yet another object of the present invention to provide a multi-purpose holster apparatus that includes a snap-on vanity plate block for presenting a company's address, trade name, and/or trademark.

It is a further object of the instant invention to provide an improved multi-purpose holster that does not hinder the use and maintenance of an object, for instance, charging a battery or storing an item.

These and other objects are achieved by the present invention which contemplates a multi-purpose holster apparatus comprising a C-shaped support frame, a female adapter or recession integral with the frame, a C-shaped spacer element, and a corresponding object support adapter for carrying one or more tools and accessories on a belt to afford ready, convenient access and reliable security of the supported object. The support frame is mounted on the belt along with the spacer element to provide a channel that encloses a portion of the belt. The object support adapter connects the object to the male adapter and the male adapter mates with the female recession, thereby mounting the object on the frame and belt.

The instant invention introduces an improved multi-purpose holster apparatus which generally comprises at least one frame adaptable for attachment to a belt, strap, waistband, or the like, an object support male adapter for receiving and accommodating objects to be holstered, an interlocking male adapter combined with the object support adapter, and a support member female recession defined by the frame which engages the male adapter with the frame. The frame is typically a rigid or semi-rigid C-shaped clamp that slides or latches onto a belt, strap, waistband, or the like. The frame includes a face plate (or front side) upper and lower lips extending back from the front side and latching flanges which protrude inwardly from the upper and lower lips to form the C-shaped clamp. The flanges are capable of holding onto the belt as they define a space between their edges which is smaller than the width of a belt. While the latching flanges are capable of securing and latching the frame to a person's belt, a C-shaped securing spacer is employed for inserting between the upper and lower lips and between the latching flanges in the back side of the frame. The C-shaped spacer is positioned inside the frame facing the back side of the frame so that a belt-receiving channel is defined for accommodating a variety of belt sizes. The C-shaped spacer fits tightly between the upper and lower lips and against the flanges, whereby the flanges latch onto the back side of the spacer so that the spacer may be retained as a semipermanent fixture if desired, yet may be removed when necessary. Accordingly, the spacer and the frame receive the belt, preventing disengagement of the frame from the belt due to the weight of heavier objects being held or from the snatching force of a would-be thief.

The female adapter protrudes from the face of the frame and provides an engaging recession to join the frame with the object support adapter by mating with the male adapter. That is, the female adapter defines the recession that actually mates and interlocks with the male adapter.

The male adapter is preferably integrally formed with the object support adapter to provide a male support adapter. The male adapter generally comprises a cylindrical shaft protruding from the object support adapter that engages the recession in a way that interlocks with the frame. The distal end of the shaft is defined by an integrally combined, substantially circular head which has a diameter which is larger than the joining shaft. While the shaft fittingly engages the recession, the head provides an interlocking member which engages a notch defined between the face of the frame and the female adapter allowing the shaft to rest in the recession.

The object support adapter generally comprises several embodiments, including an annular ring or cylinder for receiving a flashlight or other cylindrical object, an insertion body member which slidably engages a sleeve, a T-shaped bracket having a curved gripping clip defined by at least one end, or an elongated, substantially straight bracket having a curved gripping clip at each end. The gripping clips on both support adapters latch onto an edge of the object to hold the object. The brackets may also include screw apertures for aligning with preexisting threaded ports found on objects such as hand radios. Meanwhile, the annular ring adapter may comprise a shape other than circular for receiving objects such as mobile telephones. In another embodiment, the insertion member object support adapter mates with a flat, U or V-shaped sleeve having a back surface which is adherable by adhesives permanently to the object. The support adapter, in this embodiment, includes a body insertion member comprising dual rails which slidably engage channels defined by this sleeve. An interlocking member is interposed the rails for locking the male adapter into the sleeve. The sleeve is advantageous as an adhering piece compared to directly adhering the male adapter to the object. This is because the sleeve adapter provides a larger, flatter surface area which is more susceptible to permanent attachment. In addition, it provides a distinct mechanical advantage whereby it is stronger, more durable, and does not intrude with desired use of the objects.

In accordance with these and other objects which will become apparent hereinafter, the instant invention will now be described with particular reference to the accompanying drawings.

DESCRIPTION OF THE PREFERRED EMBODIMENTS

Figure 1:
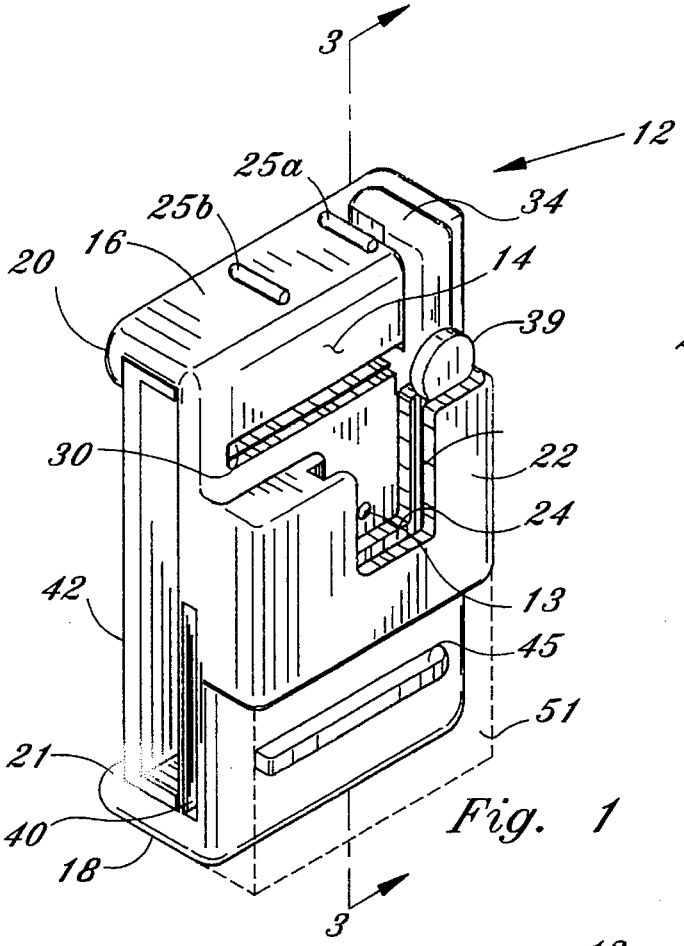
FIG. 1 shows a front perspective view of the support frame of the multi-purpose holster apparatus, with the C-shaped spacer element installed.

With reference to the drawings, FIGS. 1–25 depict a multipurpose holster apparatus generally indicated by the reference numeral 10, comprising at least one support frame 12, having a slidable interlocking key 34, object support adapters 26, 104, 128, 140, 160, or 174, a male adapter 28 integrally joined with the object support adapter and a female adapter 22 defined by the structure of the frame 12. The holster apparatus may also include a belt, strap, waistband, or the like as referenced by numeral 70 in FIG. 4 for wrapping around a person's waist, and it may also include an additional securing strap 50 for wrapping around the object. The holster is suitable for use in a variety of different applications which include receiving and holding flashlights, mobile telephones, portable tools, hand radios, etc. The holster apparatus 10 utilizes a rigid or semi-rigid frame 12 which securely mounts or latches to a belt 70, providing a mounting frame 12 for attaching the object support adapter 26 to which the object 60 is attached. The object support adapter is mounted to the frame by way of the male adapter 28 which extends from all embodiments of the object support adapter. The male adapter 28 mates with the female adapter 22, thereby mounting the object to the frame 12. Typically, the frame 12, the object support adapters, and male adapter 28 are fabricated from a plastic, thermoplastic, or a poly-carbon, which include a delrin, which is a natural lubricant material that is commonly used in making industrial gears. The delrin provides a natural oil surface which makes it easier to mate the male 28 and female 22 adapters. Note, however, that any rigid or semi-rigid material, including metal, wood, or leather may be employed.

Referring to FIGS. 1–4, the frame 12 receives a belt 70 between the upper lip 16, the lower lip 18, and the C-shaped spacer 42, wherein a channel is provided therebetween. The upper and lower lips 16, 18 are ledges which extend backward from the front or face 14 of frame 12. Projecting inwardly from the upper lip 12 and lower lip 18 and substantially parallel to the back side 15 are upper and lower latching flanges 20 and 21, respectively. The latching flanges 20, 21 project inwardly a sufficient distance to overcome the top and bottom ends of the belts so as to provide holding resistance against the back of the belt 70. Although the upper and lower latching flanges 20, 21 could latch onto the belt 70, it is preferred that a C-shaped spacer element 42 be installed within a space outlined by the flanges 20, 21, the lips 16, 18, and the frame back side 15 to provide a closed-in channel. Of course, if the element 42 is made thick enough, it could exert an additional clamping force on the belt 70 for increased security, but clamping is not necessary in this embodiment.

With reference to FIGS. 5–8, a C-shaped securing spacer 42 is inserted between the upper lip 16 and the lower lip 18, and against the flanges 20, 21 to achieve a snug, tight fit. The C-shaped spacer 42 has a front side 42*a*, an upper ledge 42*b*, a lower ledge 42*c*, and a back side 42*d*. The C-shaped spacer 42 is inserted facing the direction opposite the C-shaped frame 12 so that the back side 42*d* abuts the flanges 20, 21 and the front side 42*a* faces the frame back side 15. The upper and lower ledges 42*b* and 42*c* have a width equal to that between the flanges 20, 21 and frame back side 15 so that a tight fit is achieved. Thus, the spacer 42 and the frame back side 15 provide a belt enclosure or channel therebetween to house belt 70.

The C-shaped spacer element 42 also include securing bridges 46 extending across bridge apertures 48 at the upper and lower ends of the spacer 42. These bridges 46 are slightly resilient and support outward projecting spacer securing nipples 49 which engage corresponding securing apertures 43 on the upper and lower latching flanges 20, 21. These securing apertures 43 may be defined by flange extensions 41 which align the apertures 43 with the securing nipples 49. The nipples 49 lock or snap into the apertures 43 so that together with the tight fit achieved by the spacer's dimensions, the spacer 42 may be a semi-permanent piece. The resiliency of the bridges 46 allow the spacer 42 to be removed if desired. When the spacer element 42 is installed in the frame 12, the bridges 46 recess enough to clear the nipples 49 from the flanges 20, 21 and recover their position forcing the securing nipples 49 into the securing apertures 43. Likewise, the bridges 46 are displaced when the spacer 42 is removed, allowing the nipples 49 to clear the securing apertures 43.

In the preferred embodiment, the object support adapter 26 is joined with the frame 12 by mating the male adapter 28 with the female adapter 22. The female adapter 22 protrudes from the front side or face 14 of the frame 12 and has a cutout which defines the female recession 24 with which the male adapter 28 mates. Accordingly, the object support adapter 26 is mounted to the frame by joining the male adapter 28 with the cutout recession 24. The female adapter 22 is preferred to be integrally formed with the frame 12, but may be fixedly secured to the front side 14 by glue, rivets, hardware, adhesives, or the like, and still be in conformity with the object of the instant invention. The recession 24 is typically U-shaped for engaging the male adapter shaft 27. Preferably, the recession 24 should have smooth edges so that the male adapter 28 and object may rotate when bending over at the waist to keep the object vertically oriented at all times. By contrast, the head 29 may be modified with a cutout on its inner surface to form a ridge 29*b*, or ledge, and the key tab 39 may be truncated at its bottom end so that by sliding the key 34 over the male adapter head 29, the object is prevented from rotating. Alternatively, shaft 27 and the recession 24 may have corresponding rectangular cross sections to keep objects stationary.

Figure 1A:
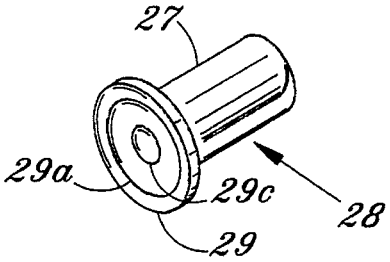
FIG. 1*a* shows a perspective view of the preferred embodiment of the male adaptor.
Figure 2:
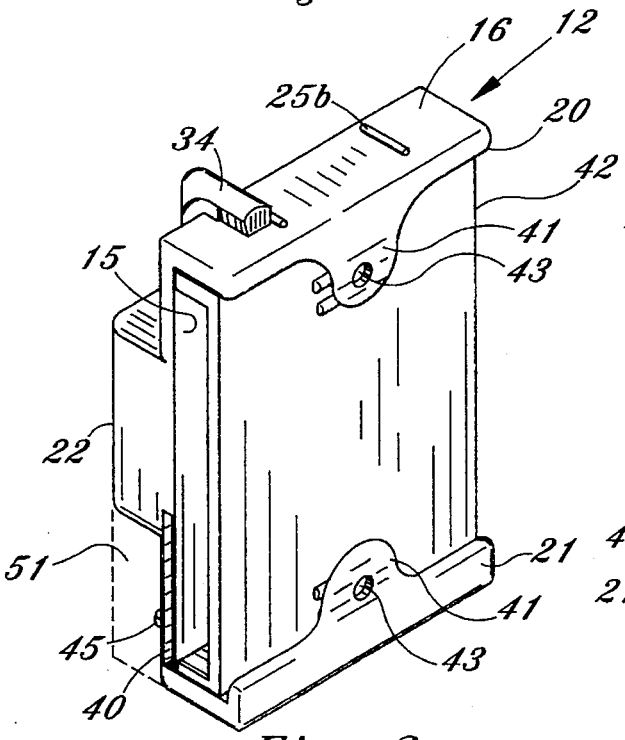
FIG. 2 shows a rear perspective view of the support frame of the instant invention, illustrating the C-shaped spacer element installed as a semi-permanent piece.
Figure 3:
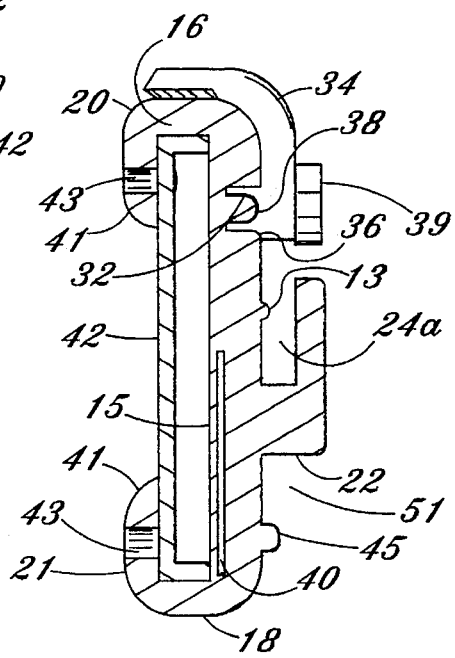
FIG. 3 shows a cross sectional view of the support frame of the instant invention taken along plane 3—3 of FIG. 1.
Figure 5:
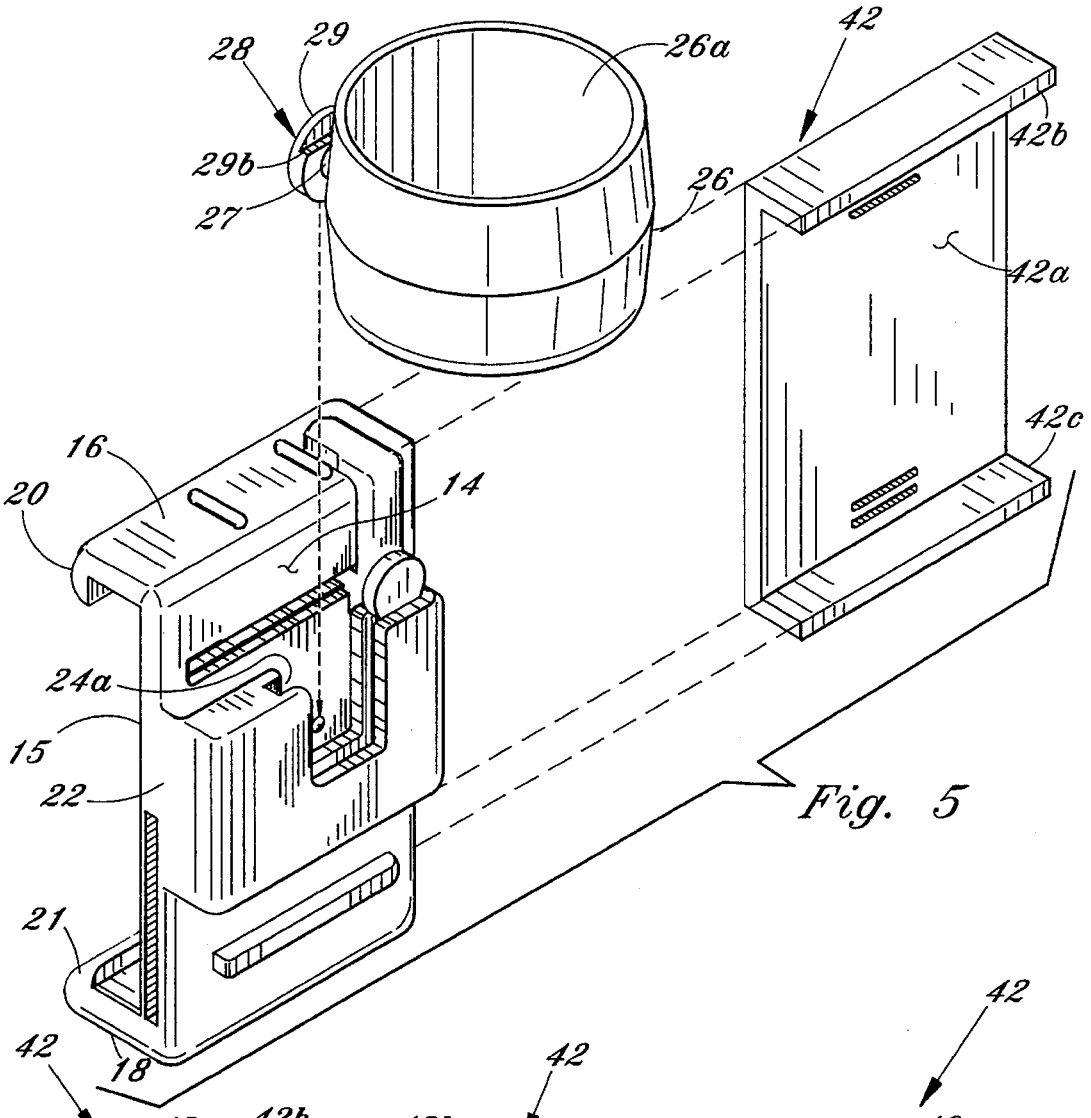
FIG. 5 shows an exploded view of the instant invention, illustrating the C-shaped spacer element and the annular ring support adapter detached from the support frame, and also illustrating the male adapter having a cutout to prevent rotation of the support adapter and object.
Figure 6:
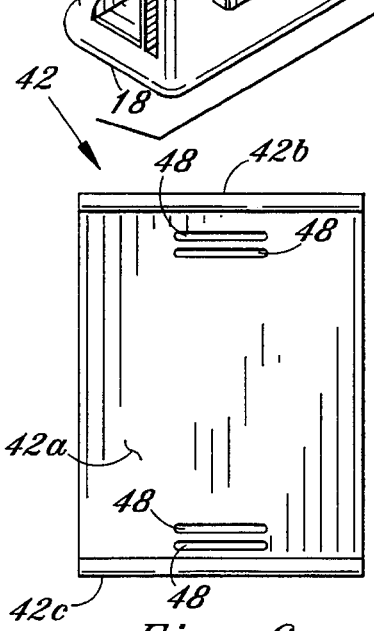
FIG. 6 is a front elevational view of the C-shaped spacer element.
Figure 7:
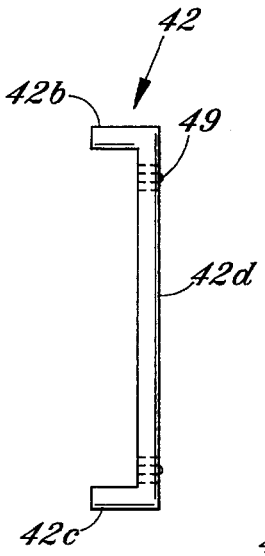
FIG. 7 is a side view of the C-shaped spacer element.
Figure 8:
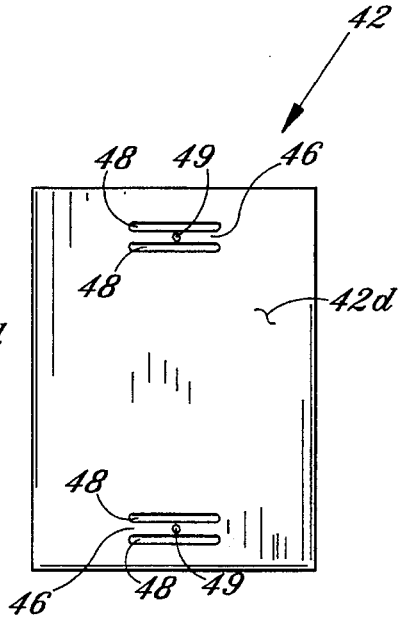
FIG. 8 is a back elevational view of the C-shaped spacer element, illustrating the latching nipples.

Referring to FIGS. 1, 3, and 5, a mating notch 24*a* is defined by a void between the female adapter 22 and the frame face 14. This notch facilitates the secured mating of the male adapter 28 and the female adapter 22 by receiving the male adapter head 29, and allowing the shaft 27 to rest in recession 24. As noted in FIG. 1A, the male adapter 28 typically comprises a cylindrical shaft 27 and a cylindrical head 29 with a diameter larger than that of the shaft 27. A dimple 29*a* may be defined by the head 29 for engaging a securing nipple 13 which projects from the frame face 14. An additional groove 29*c* may also be formed within the dimple 29*a* to further effectuate interlocking engagement with the securing nipple 13. The back side 15 and face 14 may be without reinforcement to provide a slight resiliency in the frame near the recession 24 so that the male adapter 28 can clear the nipple 13 when inserted and removed.

Figure 4:
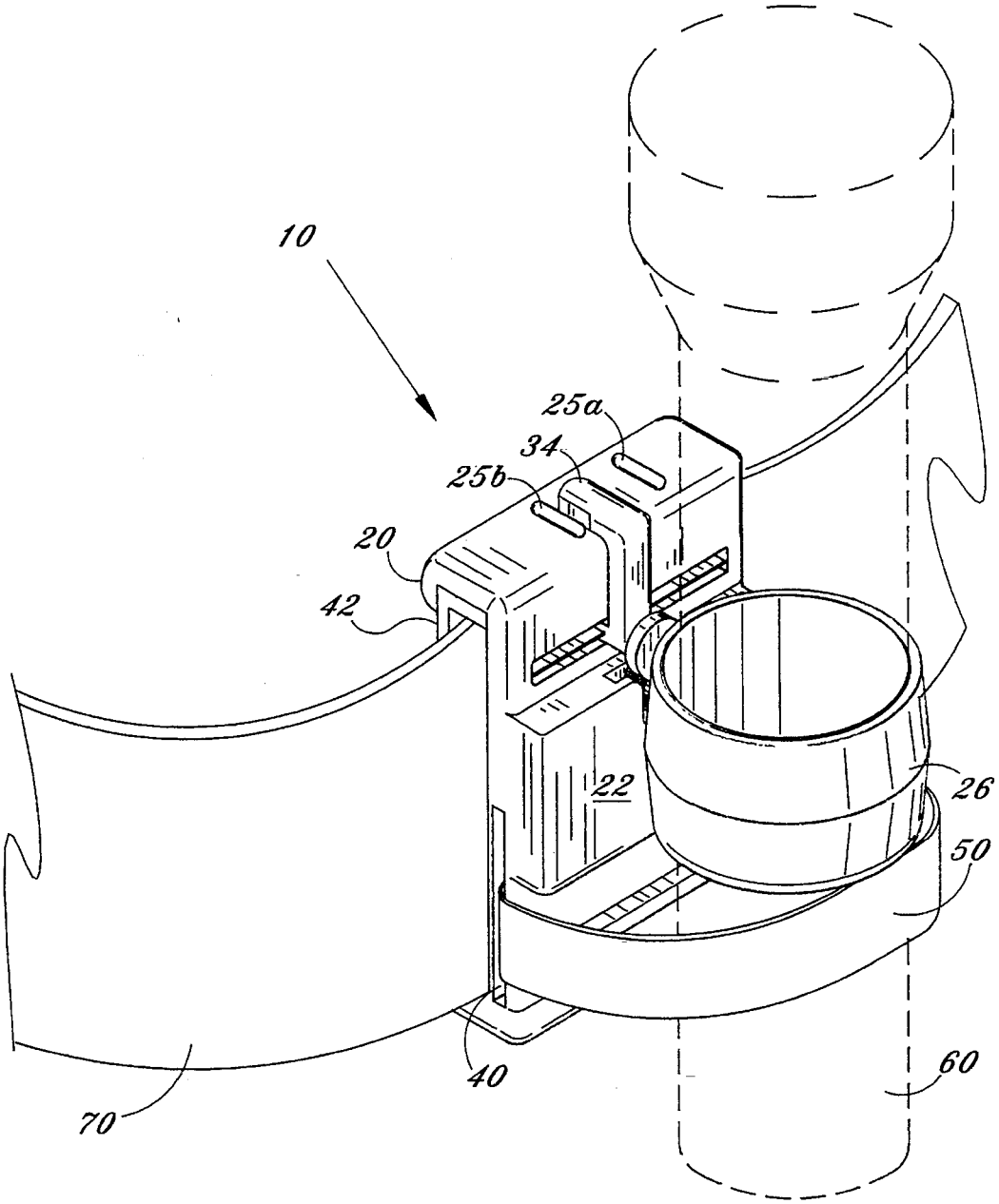
FIG. 4 shows a perspective view of the multi-purpose holster apparatus, illustrating the installment of an annular ring support adapter as used to support a flashlight shown in phantom, also illustrating the use of an additional securing strap.

As seen in FIG. 4, an additional securing strap 50 may also be employed in the instant invention for securing the object against a frame 12 as shown in FIG. 1. A strap channel 40 is defined by the frame 12 and extends across the width of the frame for allowing passage of the additional securing strap 50. The channel is defined by a space between the back side 15 (shown in FIGS. 1–5) and the front side 14 of the frame 12. The strap secures the lower end of the object 60 below the object support adapter 26, helping to immobilize and secure the object.

An additional locking mechanism performs another important feature of this additional embodiment as illustrated in FIGS. 1–5. The locking mechanism comprises a slidable interlocking key 34, a key channel 30, and an interlocking securing projection 32 disposed within channel 30. Channel 30 is an elongated opening or cutout defined by the front side 14 above the female adapter 22. The channel 30 extends above and across the female adapter 22 from one end of the recession 24 to slightly beyond the recession 24 at the opposite end. Partially intersecting this channel 30 is a securing projection 32 which is formed and defined by the interior of back side 15, such that it is disposed within the channel 30. This elongated securing projection 32 intersects and extends across the channel 30 to engage a portion of the slidable key 34.

The slidable interlocking key 34 slides along the channel 30. In a first position, the slidable key 34 allows ingress and egress of the male adapter 28, whereby clearance is allowed, and in a second position, the slidable key is traversed to the opposite side of the channel, blocking passage of the object support adapter 26. Securing ridges **25*a* and 25*b* on the top side of upper lip 16 secure the slidable key 34 in its first and second positions, respectively, so that a sufficient amount of force is required for overcoming these ridges 25*a* and 25*b* to move the slidable key 34** between the first and second positions.

The slidable key 34 is an elbow-shaped member which is mounted to the outside of the frame from the top surface of upper lip 16 down the face 14 of frame 12, contiguous with the channel 30. The slidable key 34 is in conformity with the contours of the frame from the channel 30 to the top surface of upper lip 16 and is disposed directly above the female adapter 22. The slidable key 34 has a projecting gripping clip 36 which intersects channel 30 for tight, stable, guiding control of the slidable key 34 as it is traversed between the first and second positions. The slidable key projection 36 defines an open-ended groove 38 which receives the elongated securing projection 32. The elongated securing projection 32 provides a track for which the key projection 36 and groove 38 may ride as the key 34 is maneuvered. Thus, the upper end of the slidable key 34 is manually moved by the operator from an open or first position to a locked or second position so that it skates along the top surface of upper lip 16. In the first or open position, the slidable key 34 is clear from the recession 24, as seen in FIGS. 1 and 5. By contrast, in the second or closed position, the slidable key 34 is moved to the opposite end of the channel so as to block passage of the recession 24, as seen in FIG. 4. A first ridge **25*a* secures the slidable key in the open position, while a second ridge 25*b* secures the slidable key in the closed position. Upon mating the male adapter with the female adapter 22**, the slidable key is traversed into its closed position.

A tab 39 is defined by the lower end of the slidable key 34 and is typically circular in shape, but may be otherwise. The tab 39 projects outward from the lower end of the slidable key 34 such that it is disposed slightly beyond the male adapter head 29 when it is moved across recession 24. The tab 39 may be offset slightly below the lower end of the key 34 so that a groove is formed for moving over the adapter head 29. This tab 39 may be optional, whereby the slidable key itself could adequately block passage of the male adapter 28. However, the tab 39 is preferred for aiding in maintaining the male adapter 28 within the female recession 24. The positioning of the tab 39 may be seen in FIG. 4. The tab 39 is typically circular, but may be truncated in an additional embodiment as seen in FIG. 4 to prevent rotation of the object. In addition, the cross sectional view in FIG. 3 illustrates the securing projection 32 which is disposed within channel 30 for engaging the key groove 38 as defined by the key projection 36.

Also illustrated in FIG. 4 is the vanity block 51, which may be used for displaying a company's address, trade name, or trademark. This vanity block interlocks with a vanity block projection 45, which is an elongated projection extending across the lower end of face 14. The vanity block 51 has a corresponding recession which snaps into place over the vanity block projection found on the frame. The vanity block interlocking projection 45 may be a single substantially horizontal elongated piece, or it may be a plurality of shorter vertical pieces, which correspond with recesses defined by the vanity block 51.

An additional securing strap 50 may be permanently installed in the strap channel 40 or the securing strap may have male and female buckles at opposite ends for fastening the strap around the object being held. The ends of the fastening strap may also be joined by means such as hook and loop, snaps, ties, hooks and eyes, or buttons.

The object support adapter has several embodiments, all of which are joined with the male adapter 28. The object support adapter interfaces the object with the male adapter 28 for mounting on the frame 12. In addition, the object support adapter in these embodiments is designed so as to not interfere with normal use of the object.

As referenced by FIGS. 4 and 5, one embodiment of the object support adapter comprises an annular ring support adapter 26. The support adapter has a substantially cylindrical sleeve 26 which provides a passage or channel **26*a* for receiving the object being held. This cylindrical channel 26*a* may be adapted for fitting the dimensions of the object being held and therefore is not limited to an annular shape. Integrally combined with the object support adapter 26 is the male adapter 28, which projects from the outside of the support adapter 26 to effectuate the engagement of the support adapter 26 with the frame 12. The male adapter 28 is defined by a substantially cylindrical shaft 27, which is terminated at one end by the support adapter 26, and at the other end by a male adapter engaging head 29. The engaging head 29 is slightly larger in diameter than that of the shaft, and is preferably circular or elliptical in shape. In an alternate embodiment, the head 29 may have a flat ridge 29*b* to match the tab 39 when it is truncated to prevent rotation of the adapter 26**.

In a second embodiment, the support adapter may be described as an insertion member adapter 100 as shown in FIGS. 10–13. The insertion member adapter 100 comprises an insertion member object support adapter 104 (or second object support adapter 104) integrally combined with the male adapter 28. The object support adapter 104 is joined with the object by the sleeve adapter 80. The sleeve adapter 80 is securely affixed to the object, preferably by a permanent adhesive, and the object support adapter 104 slidably engages and interlocks with the sleeve adapter 80 to mount the object to the frame 12.

Figure 14:
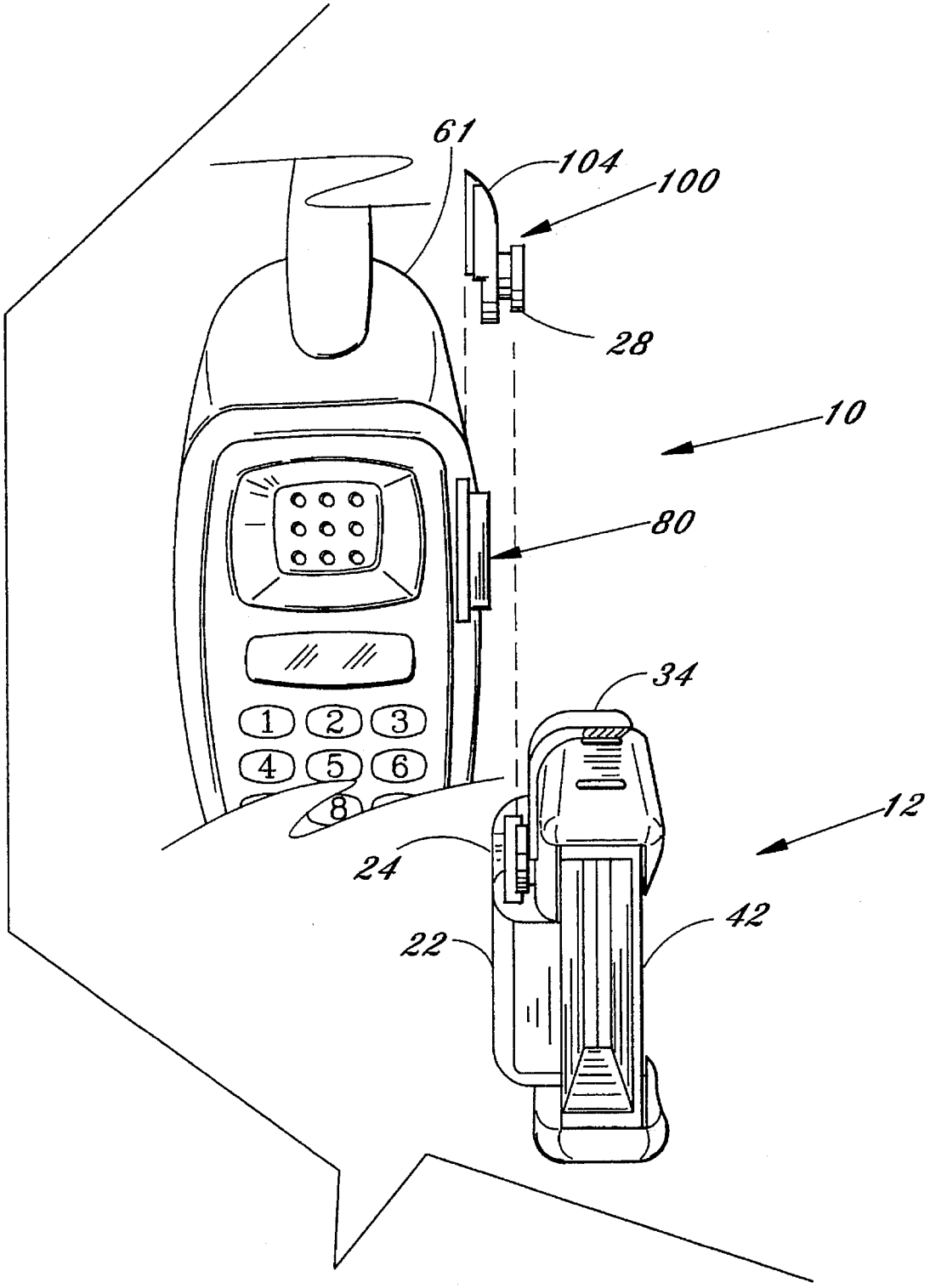
FIG. 14 is an exploded view of the insertion member adapter, the sleeve, the frame and a phone illustrating the mating of the insertion member object support adapter with the sleeve adapter and the support frame.

The sleeve adapter 80 is flat and has a straight back side, typically rectangular, that provides a greater surface area than that available with the male adapter 28 for adhering to the object. The sleeve adapter 80 has a flattened design so as to not intrude with use of the object as shown in FIG. 14. For example, items such as portable phones and hand radios may still be charged or stored without interference from the sleeve adapter 80. In addition, the flatness of the sleeve 80 does not allow any leverage to be gained for pulling the adapter 80 off the object.

Figure 9:
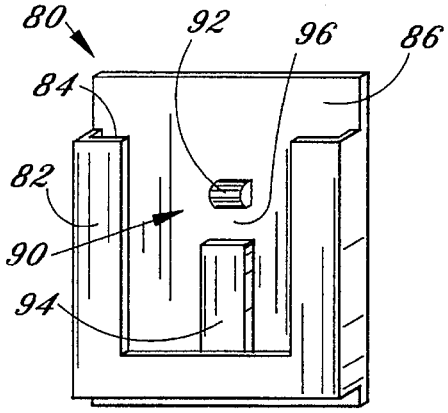
FIG. 9 shows a front perspective view of the U-shaped sleeve support adapter, illustrating the channels and interlocking member.
Figure 9A:
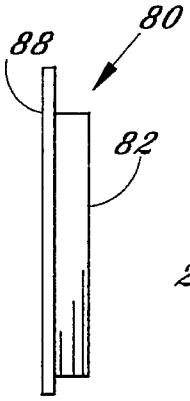
FIG. 9*a* shows a side elevational view of the U-shaped sleeve support adapter.

The sleeve adapter 80 preferably comprises a U-shaped sleeve 82 integrally combined with a sleeve adapter base 86 to form a sleeve channel 84 therebetween. The back side 88 defined by the rear side of the sleeve adapter base 86 is adhered to the object. The back side 88 may have a rough or unfinished surface to provide additional surface tension for the adhesives and adhering process. The sleeve adapter 80 also includes a snap-lock system 90 which comprises a leading arcuate post 92, a secondary elongated post 94 below post 92, and a void 96 defined therebetween. The lower edge of the arcuate post 92 and the upper edge of the elongated post 94 are at substantially 90° angles with the base 86 and define the interlocking void 96. The two posts 92 and 94 may be integrally formed with the base 86 and are interposed the sleeve 82, as shown in FIG. 9. The sleeve 82 is preferably U-shaped, but may be V-shaped, so long as the insertion member object support adapter 104 is able to slidably engage and interlock with the sleeve adapter 80.

Figure 10:
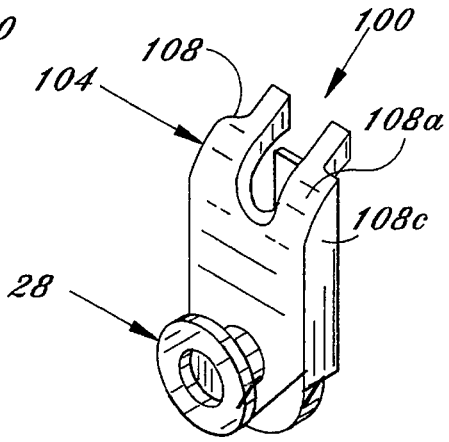
FIG. 10 is a front perspective view of the insertion member illustrating the male adapter combined with the insertion member object support adapter which slidably engages the sleeve support adapter.
Figure 11:
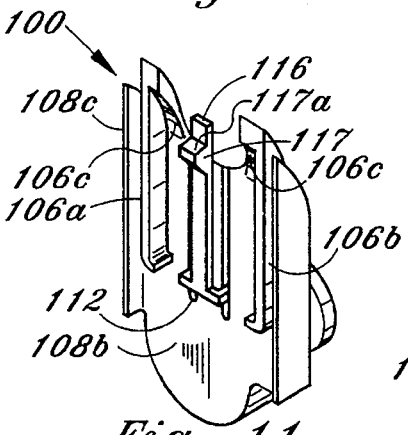
FIG. 11 is a rear perspective view of the insertion member object support adapter of the male adapter.
Figure 12:
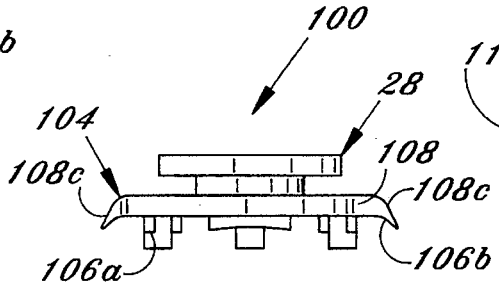
FIG. 12 is a front elevational view of the insertion member adapter illustrating the insertion member object support adapter and the dual rails which slidably engage the channels of the sleeve support adapter.
Figure 13:
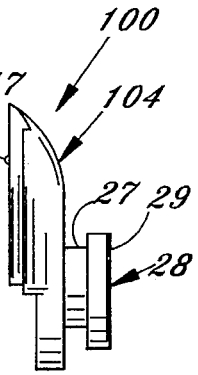
FIG. 13 is a side elevational view of the insertion member adapter.
Figure 15:
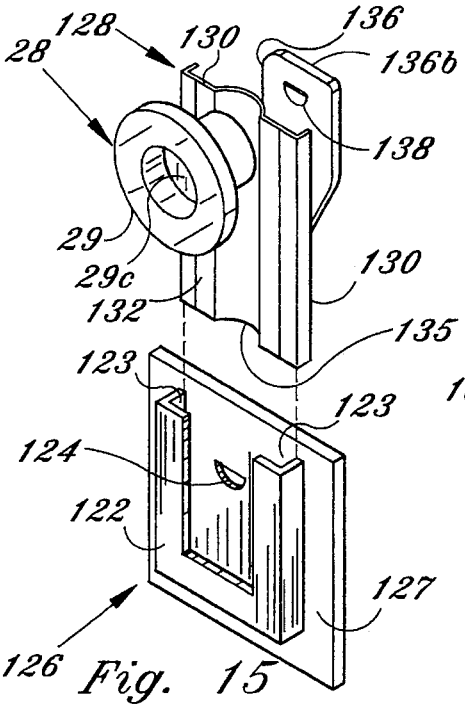
FIG. 15 is a front elevational view of an alternate embodiment of a U-shaped sleeve adapter and an insertion member adapter, illustrating a U-shaped interlocking indentation in the sleeve member and an interlocking spring biasing member integrally joined to the insertion member object support adapter.
Figure 16:
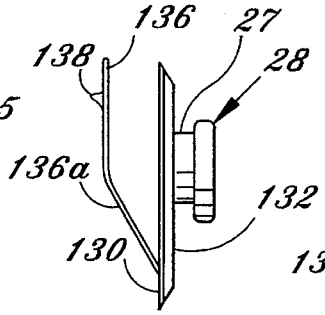
FIG. 16 is a side elevational view of the alternate embodiment of the insertion member adapter, illustrating the use of a spring biasing interlocking member.
Figure 17:
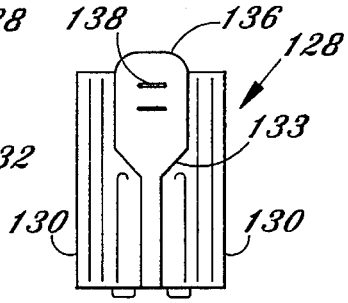
FIG. 17 is a rear elevational view of the alternate embodiment of the insertion member object support adapter, illustrating the leaf spring biasing interlocking member.

With reference to FIGS. 10–12, the second object support adapter 104 comprises a substantially flat body 108 having a top surface **108*a* from which the male adapter 28 extends, and a bottom surface 108*b* from which a dual railing 106 and a biasing element 112 depend. The insertion member body 108 has somewhat arcuate side edges that depend downward at an angle normally less than 90° to form flanges 108*c*. The flanges 108*c* make a smooth joint with the body 108 and extend downward adjacent the railings 106 so as to cover the sides of the sleeve 82, as seen in FIG. 12. The dual railing 106 comprises two parallel rails 106*a* and 106*b* which extend slightly beyond the body 108 and which have closed off ends 106*c* which terminate insertion into the sleeve 82. The closed off ends 106*c* blend into the top surface 108*a* to provide an arcuate body 108 as viewed from the side in FIG. 13. The biasing latch 112 is interposed the railings 108*a* and 108*b* and has a fixed end 114 joined to the bottom surface 108*b* at the end opposite the closed off ends 106*c*. The biasing latch free end 116 terminates slightly before the railing closed off ends 106*c*. The free end 116 is defined by a biasing latch 117 that comprises an inclined ridge extending above the biasing element 112 and a groove 117*a* below the inclination proximal the free end 110**.

An exploded view is shown in FIG. 14 to illustrate the interaction between the insertion member adapter 100, the sleeve adapter 80, and the frame 12. The back side 88 of sleeve adapter 80 is affixed to the object, such as a phone 61, with the U-shaped sleeve 82 vertically oriented. The second object support adapter 100 is positioned with the male adapter 28 facing away from the phone. The object support adapter 104 slidably engages the sleeve adapter 80 by sliding the railings **106*a* and 106*b* through channels 84 until the closed ends 106*c* meet the sleeve 82. As the object support adapter 104 slides into place, the biasing element 112 slides along the leading post 92 and the secondary post 94 until the inclined latch 117 overcomes the leading arcuate post 92, causing the biasing element to deflect until the latch 117 engages void 96. To remove the adapter 100, the biasing element 112 must be deflected again. Once the insertion member adapter 100 is interlocked with the sleeve adapter 80, the male adapter 28 is engaged with the female adapter 22 and the frame 12** as previously discussed.

In a third embodiment, the support adapter comprises a second insertion object support member 128 and a second sleeve 122. The second insertion object support member 128 comprises a raised base 132, side insertion edges 130 on a plane below the base 132, a leaf spring 136, and a leaf spring latch 138. The second insertion object support member 128 comprises side insertion edges 130 which are flat along their length and which blend into the raised base 132. The male adapter 28 is joined to the top surface of the raised base 132. The male adapter 28 may be integrally combined with the raised base 132 in an embodiment manufactured from a poly-carbon or plastic containing delrin, or the male adapter 28 may be secured to the raised base 132 by fasteners such as rivets or screws, especially when the insertion member 128 is made from a metal. The back side 133 of the raised base 132 between the side edges 130 defines a cavity where a leaf spring 136 is connected. The leaf spring has a fixed end **136*a* connected to the base and a free end 136*b*. Proximal the free end 136*b* is a leaf spring latch or plug 138** which protrudes from the back side of the leaf spring facing the direction opposite the male adapter.

The leaf spring fixed end **136*a* may be integrally joined with the base 132 or affixed by hardware such as rivets or other fasteners. The leaf spring 136 may also be connected to the top surface of the raised base 132 by an aperture defined by the distal fixed end 136*a*. In this embodiment, the end 136*a* provides an aperture through which the male adapter is connected and the leaf spring bends over the bottom end 135 and back over the cavity at an angle between 0° and 90° with the back surface 133**.

The second insertion object support member 128 mates with a U-shaped sleeve adapter 126. In this embodiment, a second U-shaped sleeve 122 is joined to a base 127, forming a channel 123 therebetween. Interposed the U-shaped sleeve is an indentation 124 defined by the base 127 for receiving the leaf spring latch plug 138 when the second insertion object support member 128 is slidably engaged with the U-shaped sleeve adapter 126. To mate the U-shaped sleeve adapter 126 and the second insertion object support member 128, the side insertion edges 130 are slid through the channels 123, causing the leaf spring 136 to deflect until the leaf spring plug 138 engages the indentation 124. In the preferred embodiment, the leaf spring plug 138 and the indentation 124 have complementary shapes, such as arcuate, for facilitating a clean mate. As previously discussed, the U-shaped sleeve adapter 126 is adhered to the object to be supported by generally permanent adhesives. The second U-shaped sleeve adapter 126 is also flat in structure to prevent removal of the adapter 126 and to prevent interference with use of the object.

Figure 19:
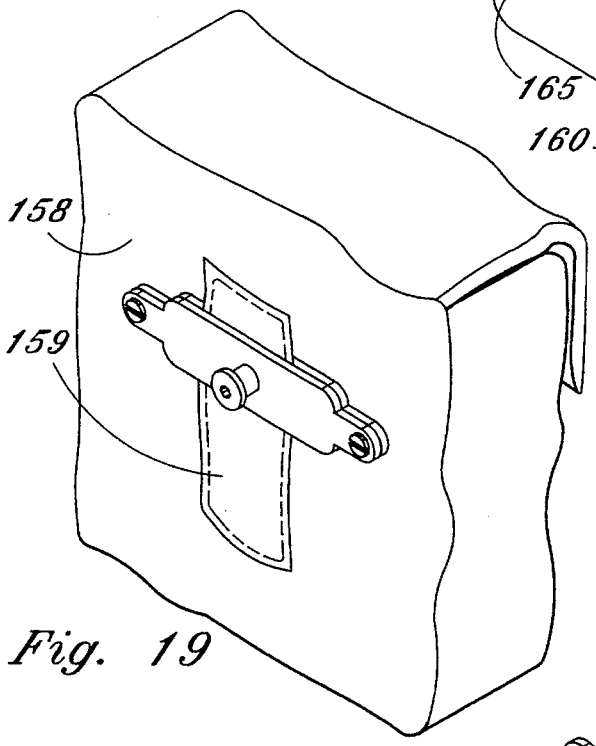
FIG. 19 is a perspective view of the T-shaped bracket as employed with a pouch having a belt loop on its back side for clamping thereto.
Figure 18:
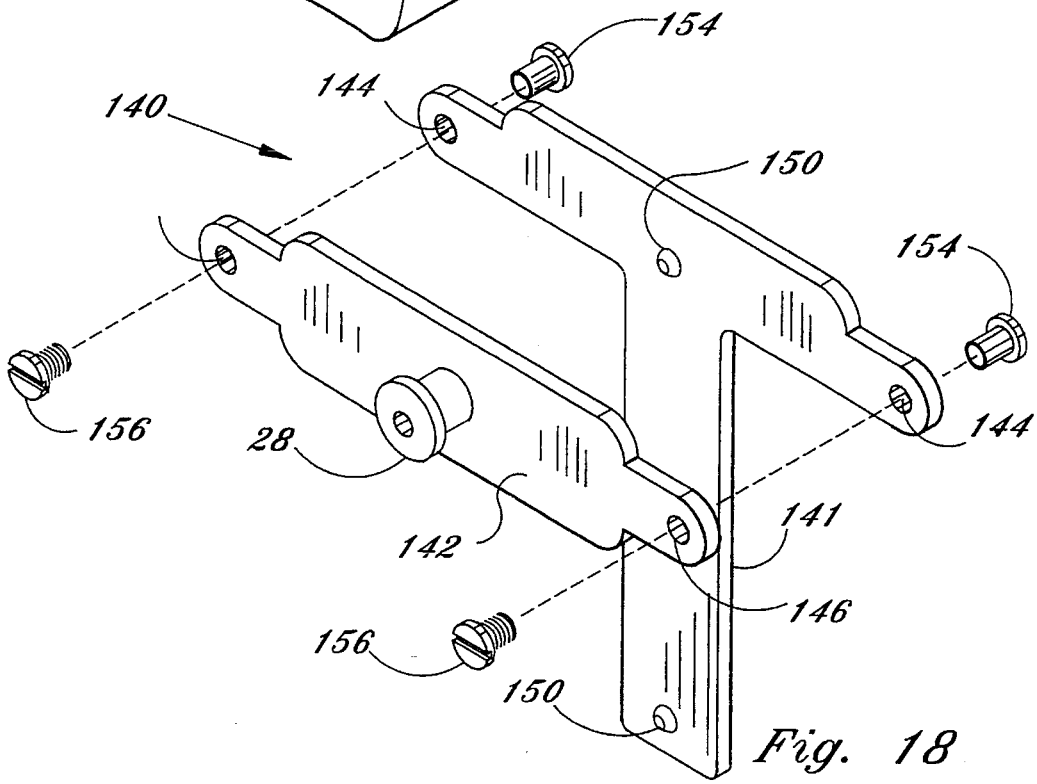
FIG. 18 shows another embodiment of the object support adapter, illustrating the T-shaped bracket support adapter, illustrating the horizontal clamping piece having the male adapter integrally combined thereto, shown exploded with the screws and female part also shown exploded.

In another embodiment shown in FIG. 18, objects are supported by T-shaped object support adapter 140 comprising a T-shaped frame or T-bracket 141, a crossbar 142, and a male adapter 28 joined to the crossbar 142. The T-shaped object support adapter 140 is designed for adapting to pouches or holsters having belt loops 159 to allow for the secured attachment of the pouches 158 to the T-shaped support adapter 140. Most pouches 158, as seen in FIG. 19, are designed with the loop or strap across their back side to receive a belt. In the present invention, the T-shaped object support adapter 140 clamps onto the strap 159 and mounts to the frame so the pouch 158 may be removed without having to remove the belt.

The T-bracket 141 has fastener apertures 144 at both ends of the horizontal section which align with fastener apertures 146 defined by the crossbar 142. The T-bracket 141 is inserted between the pouch 158 and belt loop 159 and secured thereto by the crossbar 142 and pointed bits 150. The pointed bits 150 are preferably conical and project from the T-frame proximal the bottom end of the vertical portion and near the center of the horizontal section. The bits 150 bite into the strap 159 when the crossbar 142 is secured to the T-bracket 141, helping to prevent the T-bracket support adapter 140 from sliding.

The crossbar 142 is a corresponding member that secures the T-frame 141 to the pouch 158 by clamping the strap 159 to the T-bracket 141. The crossbar 142 and the T-bracket 141 clamp onto the strap 159 with the help of fasteners such as nuts and bolts so as to secure the T-frame 141 to the pouch 158. Crossbar 142 coincides with the horizontal section of the T-bracket 141 and has a first and second aperture 146 which align with the apertures 144 defined by the T-bracket 141. A female threaded port or threaded rivet 154 is inserted individually through T-bracket apertures 144 and extends into the crossbar apertures 146 which are in alignment with the T-bracket apertures 144. A threaded screw or bolt 156 is used to threadably engage the female threaded piece inserted through the apertures. Protruding from the crossbar 142 is a corresponding male adapter which mates with the female adapter 22 to clip the T-shaped object support adapter 140 and pouch 158 to the belt frame 12.

Figure 21:
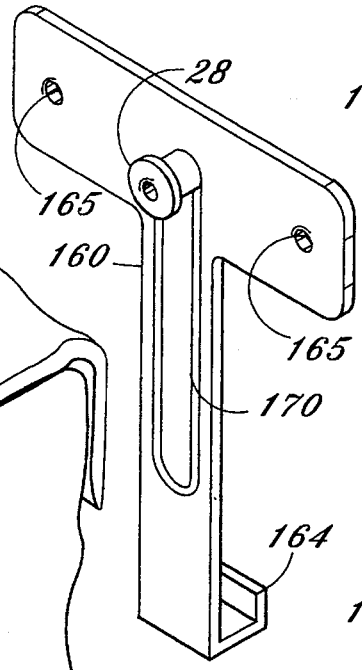
FIG. 21 is a perspective view of the second T-shaped bracket.
Figure 22:
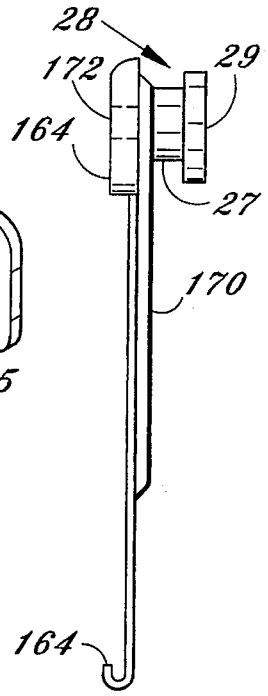
FIG. 22 is a side elevational view of the second T-shaped bracket.
Figure 20:
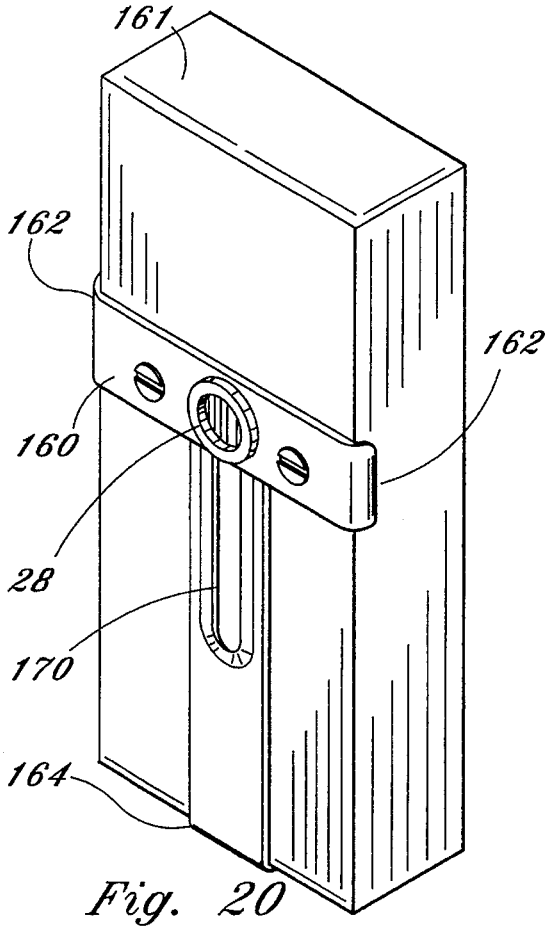
FIG. 20 is a perspective view of a second T-shaped bracket as used with items such as hand radios having preexisting threaded female ports for attaching the T-shaped bracket to the radio by use of fastener screws.

Referring to FIGS. 20–22, a second T-bracket object support adapter 160 may also be utilized for secured attachment to commercial radios or phones, for mounting onto a belt via the belt frame 12. The second T-adapter 160 comprises a single T-shaped piece defining a curve-gripping lip 164 at its lower end and oppositely disposed apertures 165 at the upper or horizontal section of the frame 160. The apertures 165 align with preexisting threaded ports on the radio 161. Most commercial radios have a battery pack at their lower end which slidably engages with the lower end of the radio 161 to provide the necessary power to operate the radio. When this battery pack is removed from the radio, a lip is exposed. The gripping clip 164 engages or clips onto the lip while the apertures 165 line up with the threaded ports so that the T-frame object support adapter 160 may be securely mounted to the radio. Accordingly, this T-frame 160 is designed to complement various commercial radios, wherein the T-frame 160 may be increased or decreased in size to align the apertures 165 with corresponding threaded female ports. Once the T-frame 160 is mounted to the radio, the battery pack may be slid back onto the radio, completely securing the gripping clip 164 of the second T-frame in place. To secure the top end of the T-frame 160, threaded bolts 168 or other fasteners threadably engage through apertures 165 into the threaded ports defined by the back side of the radio. Protruding from the upper end of the second T-frame 160 is the male adapter 28 as previously described for mounting on the frame 12. The T-frame 160 may also have a raised center portion 170 for mounting the male adapter 28 to provide a cavity on the back side for seating a recessed fastener 172, such as a rivet, used in securing the male adapter 28. The second T-bracket 160 may also have outer ends 162 which curve inward to hug the sides of the object.

Figure 23:
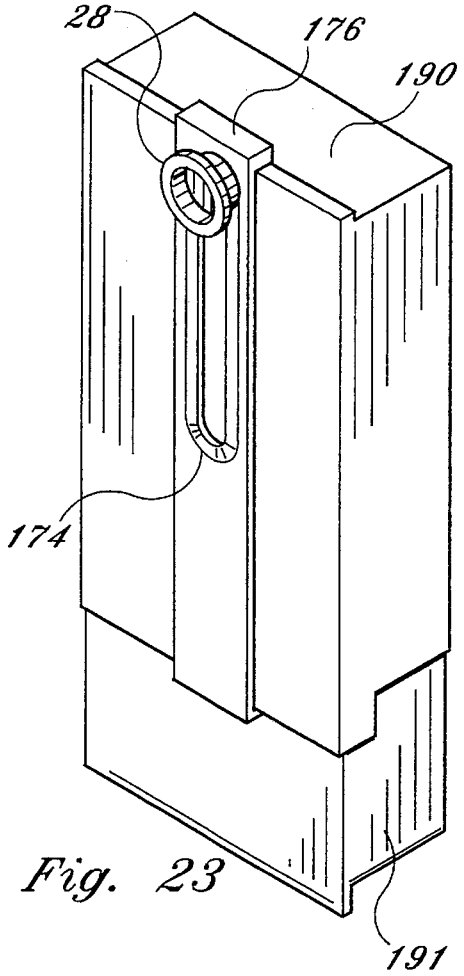
FIG. 23 is a perspective view of the straight bar bracket support adapter as used with an object having preexisting ridges for gripping the straight bracket support adapter to the object.
Figure 24:
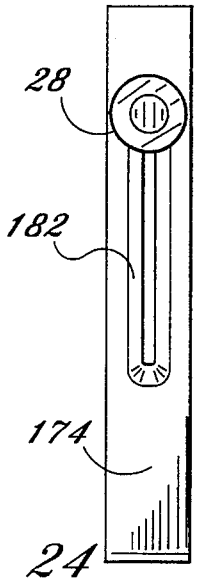
FIG. 24 is a front elevational view of the straight bracket support adapter.
Figure 25:
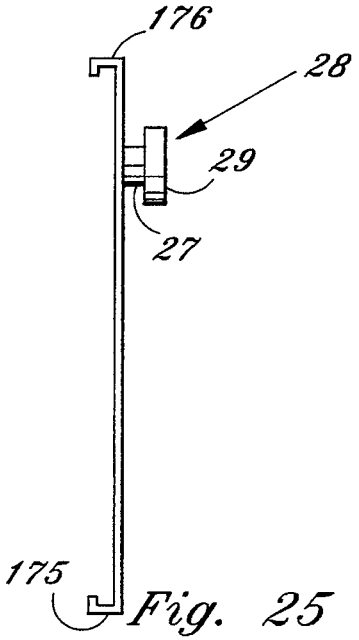
FIG. 25 is a side elevational view of the straight bar support adapter, illustrating the male adapter and gripping clips.

An additional embodiment of the instant invention is shown in FIGS. 23–25, and comprises a straight bracket object support adapter 174. The straight bracket 174 has a hooked upper end 176 and a hooked lower end 175, as shown in FIGS. 24 and 25. The bracket 174 is adaptable to radios 190 having removable battery packs 191 that leave a lip or flange when the battery is removed for latching onto and other objects having a lip or flange at both the upper and lower ends. The male adapter is fastened to the straight bracket 174 by fasteners, such as rivets. The male adapter 28 is positioned so that it is off-center, being more proximal to the top end of the bracket 174 for balancing the object. A raised portion 182 may also be provided for mounting the male adapter 28 so that the fastener may be recessed inside a cavity formed on the back of the bracket 174 as formed by the raised portion 182. The bracket 174 may also define apertures for securing the bracket with fasteners to objects having preexisting mating fastener ports.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A multi-purpose holster apparatus for supporting an object on a belt, said apparatus comprising:

a frame having a front side, a back side, an upper lip, and a lower lip, said frame defining a belt channel for receiving a belt, said upper lip and said lower lip each having an inward facing flange such that each said flange is substantially parallel with said back side;

a female adapter protruding from said front side;

an object support adapter for supporting an object to be mounted on said frame;

a male adapter for interlocking and mating with said female adapter, said male adapter comprising a shaft extending outward from said object support adapter, said shaft defining a girth which facilitates mating with said female adapter so as to engage said object support adapter with said frame;

a slidable locking mechanism attached to said frame for preventing the removal of said male adapter from said female adapter;

a spacer removably and securely inserted between said upper lip and said lower lip so as to enclose said channel; and means for attaching the object to said object support adapter.

2. An apparatus as recited in claim 1, wherein said spacer further comprises:

a C-shaped spacer inserted tightly against said flanges facing toward said backside, said C-shaped spacer having a height substantially equal to a distance between said upper lip and said lower lip so that said C-shaped spacer is a semi-permanent piece requiring significant force for removal.

3. An apparatus as recited in claim 2, wherein said female adapter further comprises a substantially U-shaped recession defined by said female adapter wherein said recession receives said shaft.

4. An apparatus as recited in claim 1, wherein said means for attaching the object to said object support adapter comprises:

a sleeve adapter affixed to the object, said sleeve adapter comprising a sleeve adapter base and a sleeve protruding from said sleeve adapter base, said sleeve adapter base and said sleeve defining a support channel therebetween for receiving said object support adapter, said sleeve adapter being substantially flat so as to not interfere with use of the object; and means for affixing said sleeve adapter to the object.

5. An apparatus as recited in claim 4, wherein said sleeve comprises:

a first leg joined to said sleeve adapter base; and a second leg joined to said sleeve adapter base and operatively associated with said first leg, said first leg and said second leg and said sleeve adapter base defining said support channel.

6. An apparatus as recited in claim 5, wherein said sleeve adapter further comprises:

means for releasably interlocking said object support adapter in said sleeve adapter, said means for releasably interlocking said object support adapter interposed said first leg and said second leg.

7. An apparatus as recited in claim 6, wherein said means for releasably interlocking said object support adapter comprises a void defined by said sleeve adapter base.

8. An apparatus as recited in claim 7, wherein said object support adapter comprises:

a support adapter base having a top surface and a bottom surface, said male adapter extending from said top surface;

a first railing depending from said bottom surface of said support adapter base, said first railing engaging said support channel through said first leg;

a second railing depending from said bottom surface of said support adapter base, said second railing engaging said support channel through said second leg; and a biasing element fixed at one end to said support adapter base and extending below said bottom surface, said biasing element having a latch for engaging said void.

9. An apparatus as recited in claim 5, wherein said object support adapter comprises:

a support adapter base having a top surface and a bottom surface, said male adapter extending from said top surface; and at least two rails depending from said bottom surface of said support adapter base, said at least two rails engaging said support channel through said sleeve.

10. An apparatus as recited in claim 9, further comprising means for releasably interlocking said object support adapter in said sleeve adapter.

11. An apparatus as recited in claim 10, wherein said means for releasably interlocking said object support adapter in said sleeve adapter comprises:

a void defined by said sleeve adapter base; and a biasing element fixed at one end to said support adapter base and extending below said bottom surface, said biasing element having a latch for engaging said void.

12. An apparatus as recited in claim 1, wherein said object support adapter comprises:

a T-shaped bracket having a horizontal section and a vertical section, said T-shaped bracket for use with a pouch having a loop whereby said T-shaped bracket slides inside the loop;

a cross bar for attaching to said T-bracket so as to clamp the loop therebetween, said male adapter extending from said cross bar; and means for attaching said cross bar to said T-shaped bracket.

13. An apparatus as recited in claim 12, wherein said means for attaching said cross bar to said T-shaped bracket comprises:

at least two bracket apertures defined by said T-shaped bracket; and at least two cross bar apertures defined by said cross bar, said at least two cross bar apertures being in alignment with said at least two bracket apertures when said cross bar is attached to said T-shaped bracket for receiving fasteners to securely attach said cross bar to said T-shaped bracket.

14. An apparatus as recited in claim 1, wherein said object support adapter comprises:

a T-shaped bracket having a horizontal section and a vertical section, said T-shaped bracket having at least two apertures for aligning with fastening ports on objects having fastener ports, said at least two apertures for receiving fasteners that mate with the fastening ports, said male adapter extending from said horizontal section; and a curved clip defined by said vertical section for latching on to the object.

15. An apparatus as recited in claim 1, wherein said object support adapter comprises:

a bracket for attaching to the object, said bracket defining at least two curved clipped ends for latching on to the object, said male adapter extending from said bracket.

16. An apparatus according to claim 1, wherein said female adapter defines a recession and said slidable locking mechanism comprises:

a groove defined by said frame, said groove located above said recession, said groove extending from one end of said recession to slightly beyond said opposite end of said recession;

a slidable key attached to said frame, said key partially intersecting said groove; and at least one ridge protruding from said frame for securing said key over said recession in a locked position.

17. An apparatus according to claim 16, wherein said slidable key further comprising:

an upper end and a lower end defined by said slidable key;

a groove projection interposed said groove, said groove projection extending across said groove; and a key projection protruding from the lower end of said key and intersecting said groove such that said key projection engages said groove projection, said key projection defining an open ended groove for receiving said groove projection, said groove projection providing a track on which said groove slides for guiding said key projection along said groove between a first position and a second position, said groove projection exerting a frictional force for stabilized control of said key projection.

18. An apparatus according to claim 16, wherein said slidable key further comprises a key tab projecting from the lower end of said slidable key, said tab partially extending below said lower end such that a space is defined between said frame front side and said tab for passing over said male adapter when said male adapter is mated with said female adapter.

19. An apparatus according to claim 1 further comprising:

a vanity block releasably attached to said frame, said vanity block for displaying information; and means for releasably attaching said vanity block to said frame.

20. An apparatus according to claim 1, further comprising means for preventing said male adapter from rotating.

21. An apparatus as recited in claim 1, wherein said object support adapter comprises:

a sleeve, said sleeve defining a passage for receiving the object, said means for attaching the object to said object support adapter comprising said passage, said male adapter extending from said sleeve.

22. A multi-purpose holster apparatus for supporting an object on a belt, said apparatus comprising:

a frame defining a belt channel for receiving a belt;

means for removing the frame from the belt while the belt remains fastened, said removing means being releasably secured to said frame;

a female adapter protruding from said frame, said female adapter defining a recession;

an object support adapter for supporting an object to be mounted on said frame;

a male adapter for interlocking and mating with said female adapter, said male adapter comprising a shaft extending outward from said object support adapter, said shaft defining a girth which facilitates mating with said female adapter so as to engage said object support adapter with said frame;

a slidable locking mechanism attached to said frame for preventing the removal of said male adapter from said female adapter; and means for attaching the object to said object support adapter.

23. An apparatus according to claim 22, wherein said removing means comprises:

a spacer firmly and removably secured to said frame so as to define said channel.

* * * * *